US007693644B2

(12) United States Patent
Aliakbarzadeh et al.

(10) Patent No.: US 7,693,644 B2
(45) Date of Patent: Apr. 6, 2010

(54) REGULATOR DEVICE FOR COMPENSATING FOR DISPERSIONS OF INJECTORS

(75) Inventors: Reza Aliakbarzadeh, Regensburg (DE); Dirk Joachimsmeyer, Hausen (DE)

(73) Assignee: Continental Automotive GmbH, Hannover (DE)

( * ) Notice: Subject to any disclaimer, the term of this patent is extended or adjusted under 35 U.S.C. 154(b) by 124 days.

(21) Appl. No.: 11/885,581

(22) PCT Filed: Feb. 27, 2006

(86) PCT No.: PCT/EP2006/060305

§ 371 (c)(1),
(2), (4) Date: May 29, 2008

(87) PCT Pub. No.: WO2006/092389

PCT Pub. Date: Sep. 8, 2006

(65) Prior Publication Data

US 2008/0281503 A1 Nov. 13, 2008

(30) Foreign Application Priority Data

Mar. 4, 2005 (DE) ..... 10 2005 010 028

(51) Int. Cl.
*F02D 41/14* (2006.01)
*F02D 41/20* (2006.01)

(52) U.S. Cl. ..... 701/105; 123/498

(58) Field of Classification Search ..... 701/105, 701/102, 115; 123/478, 498, 480; 239/585.1, 239/585.5

See application file for complete search history.

(56) References Cited

U.S. PATENT DOCUMENTS

| | | | | |
|---|---|---|---|---|
| 6,766,791 | B2 * | 7/2004 | Bock et al. | 123/498 |
| 6,986,339 | B2 * | 1/2006 | Joos et al. | 123/498 |
| 7,578,280 | B2 * | 8/2009 | Fujii | 123/478 |

FOREIGN PATENT DOCUMENTS

| | | | |
|---|---|---|---|
| DE | 195 44 720 | C1 | 3/1997 |
| DE | 19642653 | C1 | 1/1998 |
| DE | 197 06 126 | A1 | 8/1998 |
| DE | 19706126 | A1 | 8/1998 |
| DE | 19945618 | A1 | 3/2001 |
| DE | 10206906 | C1 | 11/2003 |
| DE | 102 33 778 | A1 | 2/2004 |
| DE | 10306458 | A1 | 8/2004 |
| EP | 1 338 780 | A2 | 8/2003 |

* cited by examiner

*Primary Examiner*—Hieu T Vo
(74) *Attorney, Agent, or Firm*—King & Spalding L.L.P.

(57) ABSTRACT

Injectors each having a piezo actuator are assigned to cylinders of an internal combustion engine. A regulator device is configured for furnishing a cylinder-specific controlled variable and a command variable to a controller whose primary manipulated variable is a variable representing an electrical power supplied to the piezo actuator during a control cycle. A manipulated variable splitting unit is provided whose input variable is a regulator-determined regulator value of the primary manipulated variable and is configured for determining a total value of the primary manipulated variable according to the regulator value. It is also configured for splitting the total value into a primary value of the primary manipulated variable and into a secondary value of a secondary manipulated variable according to a lower and/or upper threshold value of the total value.

11 Claims, 4 Drawing Sheets

REGULATOR DEVICE FOR COMPENSATING FOR DISPERSIONS OF INJECTORS

CROSS REFERENCE TO RELATED APPLICATIONS

This application is the U.S. National Stage of International Application No. PCT/EP2006/060305, filed Feb. 27, 2006 and claims the benefit thereof. The International Application claims the benefits of German application No. 10 2005 010 028.7 filed Mar. 4, 2005, both of the applications are incorporated by reference herein in their entirety.

FIELD OF INVENTION

The invention relates to a regulator device for compensating for dispersions of injectors, each having a piezo actuator, which is assigned to cylinders of an internal combustion engine.

BACKGROUND OF THE INVENTION

Internal combustion engines are increasingly equipped with injectors to which piezo actuators are assigned as adjustment drives. These types of injector have the advantage that very short valve opening times of the injectors can be achieved with them and thus a number of part injections are possible during one operating cycle of a cylinder of the internal combustion engine. In conjunction with a very high operating pressure −200 bar in the case of gasoline internal combustion engines for example—a very good preparation of the air-fuel mixtures is also possible in this way for direct injection of the fuel into the respective cylinders. In the case of a precise control of the injector this makes it possible to increase the efficiency of the internal combustion engine and especially to keep pollutant emissions low, which is necessary as a consequence of strict emissions legislation.

A method for controlling an internal combustion engine in the region of the lean limit is known from DE 197 06 126 C2. The method is used for internal combustion engines with leaner combustion with a fuel-air ratio λ, which is greater than in the stoichiometric case, i.e. with a lean mixture. This enables a greater efficiency of the internal combustion engine to be obtained. As the lean shift increases however the fluctuations between the combustion cycles rise, until finally inflammation dropouts occur. Uneven running values are determined for individual cylinders for fluctuations in the angular speed of the crankshaft. These are compared to predetermined uneven running values and fed to a regulator by means of which a maximum air-fuel ratio is adapted and the injection valves are activated accordingly.

A method for detecting combustion dropouts in a multi-cylinder internal combustion engine by evaluating the crankshaft speed is known from DE 195 44 720 C1. Segment time durations are measured, which the crankshaft needs during the operating cycles of the individual cylinders to pass through predetermined angular ranges. Furthermore these segment times are corrected with a correction factor which contains the mechanical tolerances of the rev counter. Uneven running values are calculated from the corrected segment times. The uneven running values are compared to a threshold value and misfiring is registered if the threshold value is exceeded.

SUMMARY OF INVENTION

The object of the invention is to create a regulator device for compensating for dispersions of injectors which allows a precise and convenient operation of an internal combustion engine.

The object is achieved by the features of the claims.

The outstanding feature of the invention is a regulator device for compensating for dispersions of injectors having a piezo actuator in each case. The injectors are each assigned to cylinders of the internal combustion engine. The regulator device is embodied to supply a cylinder-specific controlled variable and a command variable to a controller, of which the primary manipulated variable is a variable which represents electrical power supplied to the piezo actuator during an activation cycle. An activation cycle can be understood as a period for a crankshaft angle between two consecutive injections of fluid by the injector and thus for example the period from the beginning of the activation of the piezo actuator for the injection of fluid until the renewed activation of the piezo actuator for a further injection of fluid. This also includes an intended control of a staged lift of the actuator.

A manipulated variable splitting unit is provided, the input variable of which is a regulator value of the primary manipulated variable determined by the regulator. The manipulated variable splitting unit is embodied for determining a total value of the primary manipulated variable depending on the regulator value. It is further embodied for splitting the total value into a primary value of the primary manipulated variable and a secondary value of a secondary manipulated variable, depending on a lower and/or upper threshold value of the total value. The upper and the lower threshold values are suitably predetermined. This enables a non-linear range of the adjustment behavior of the piezo actuator to be avoided in a simple and reliable manner during operation of the injector. The result of this is that the fluid mass to be injected by the respective individual injector is able to be set very precisely. In this way an even injection of fluid by the different injectors is possible. This enables the internal combustion engine to be run in a way which is largely free of rotational irregularities.

In accordance an advantageous embodiment of the invention the manipulated variable splitting unit is embodied to limit the range of values of the primary value in relation to its lower value range limit to the lower value threshold and/or in relation to its upper value range limit to the upper value threshold. In this way the undesired non-linear area of the adjustment behavior of the piezo actuator can be avoided especially reliably by suitable choice of the upper or lower threshold value respectively.

In accordance a further advantageous embodiment of the invention the manipulated variable splitting unit is embodied to increase the secondary value beyond the necessary amount needed for implementing the difference between the total value and of the primary value when the regulator value exceeds the upper threshold, and to retain the increase until the regulator value falls below a hysteresis value in relation to the upper threshold value. In this way a regulation reserve can be created simply in respect of the primary value in relation to the upper threshold value. It is thus not necessary for the road behavior to be very precisely known and have to be modeled accordingly in relation to the secondary manipulated variable. Instead inaccuracies in the implementation of the secondary value by the primary value can be regulated in a simple manner as part of the regulation. Further manipulated variables can also be precisely regulated out in this manner. Overall a very precise operation of the injectors is possible.

In this context it is further advantageous for the manipulated variable splitting unit to be embodied to increasingly raise the secondary value beyond the amount needed for implementing the difference between the regulator value and the primary value until the regulator value exceeds a regulator reserve value in relation to the upper threshold value. In this way a predeterminable regulation reserve can be precisely maintained in a simple manner.

In accordance with a further advantageous embodiment of the invention the manipulated variable splitting unit is embodied to decrease the secondary value beyond the amount needed for implementing the difference between the regulator value and the primary value when the regulator value falls below the lower threshold value, and retain the decrease until the regulator value exceeds a hysteresis value in relation to the lower threshold value. The hysteresis value is suitably predetermined. In this way too a predeterminable regulation reserve can be created in respect of the primary value.

In this context it is further advantageous for the manipulated variable splitting unit to be embodied to increasingly decrease the secondary value beyond the amount needed for implementing the difference between the regulator value and the primary value until the regulator value exceeds a regulator reserve value in relation to the lower threshold value. In this way a predeterminable regulation reserve can likewise be maintained in a simple manner.

In accordance with a further advantageous embodiment of the invention the regulator is a cylinder-specific Lambda regulator. In accordance with a further advantageous embodiment of the invention the regulator is an uneven running regulator.

In accordance with a further advantageous embodiment of the invention the regulator device is embodied for determining the total value as a function of a pilot control value of the primary manipulated variable, which is determined as a function of at least one operating variable of the internal combustion engine. Operating variables of the internal combustion engine are to be understood as process variables and also as variables derived from these, such as for example a temperature of the piezo actuator or a pressure of the fluid, which can be injected via the injector or also a so-called duty cycle which represents a relationship between an on-time and an off-time of the injector, with fuel being injected during the on-time and no fuel being injected during the off-time.

In accordance with a further advantageous embodiment of the invention the secondary manipulated variable is a variable which represents an injection period of the injector.

BRIEF DESCRIPTION OF THE DRAWINGS

Exemplary embodiments of the invention are explained below with reference to schematic diagrams.

The figures show.

Elements which are constructed or which function in the same way are identified by the same reference symbol in all figures.

DETAILED DESCRIPTION OF INVENTION

Figure 1:
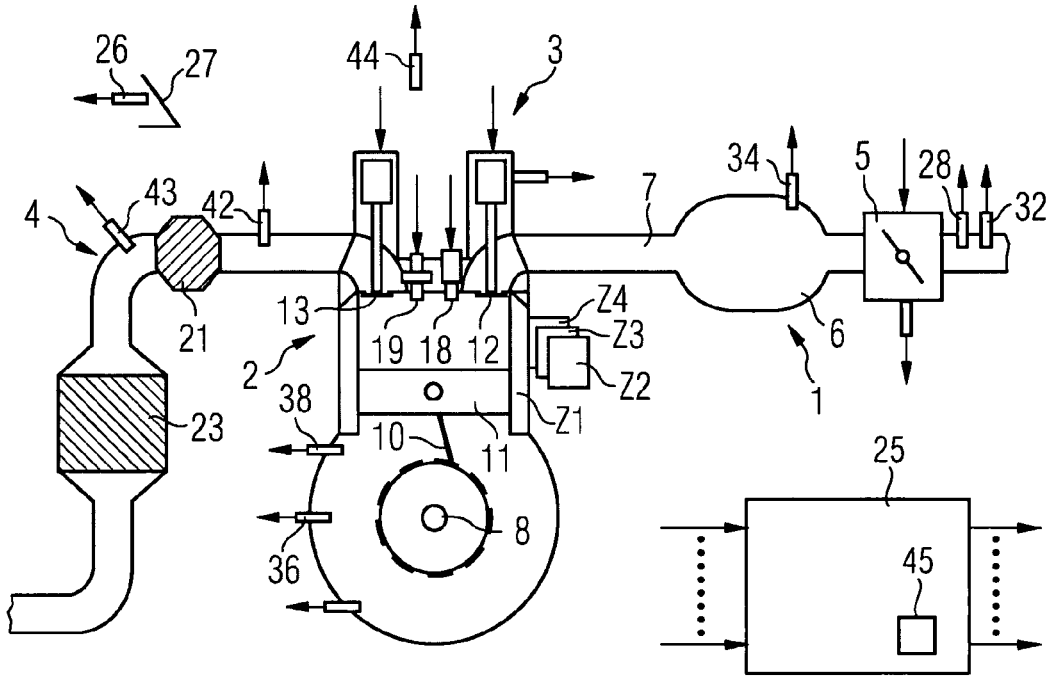
FIG. 1 an internal combustion engine with a control device.

An internal combustion engine (FIG. 1) comprises an induction tract 1, an engine block 2, a cylinder head 3 and an exhaust gas tract 4. The induction tract 1 preferably comprises a throttle valve 5, also a collector 6 and an induction pipe 7 which is routed through to the cylinder Z1 via an inlet channel in the engine block 2. The engine block further comprises a crankshaft 2, which is coupled via a connecting rod 10 to the piston 11 of the cylinder Z1.

The cylinder head 3 includes valve gear with a gas inlet valve 12 and a gas exhaust valve 13.

The cylinder head 3 further includes an injector 18, which can also be referred to as an injection valve, and if necessary a spark plug 19. Alternatively the injector 18 can also be arranged in the induction pipe 7. The injector includes a piezo actuator, via which the position of an injector needle of the injector 18 is set and thereby the injection of the fuel by the injector is controlled. In a closed position the injector needle suppresses the injection of the fuel. Outside the closed position, especially in an open position, the injector needle releases the fuel flow. The lifting of the injector needle out of its closed position and into its closed position is able to be controlled by supplying electrical power to the piezo actuator or removing power from it.

An exhaust gas catalyzer 21 which is embodied as a three-way catalyzer is arranged in the exhaust gas tract. A further exhaust gas catalyzer is also preferably arranged in the exhaust gas tract, which is embodied as an NOx exhaust gas catalyzer 23.

A control device 25 is provided to which sensors are assigned which detect different process variables and determine the value of the measurement variable in each case. The control device 25 determines as a function of at least one of the measurement variables manipulated variables, which are then converted into one or more adjustment signals for controlling the adjusting elements by means of corresponding adjusting drives.

The sensors are a pedal position sensor 26, which records a position of the gas pedal 27, an air mass sensor 28, which records an air mass flow upstream of the throttle valve 5, a first temperature sensor 32, which records an induction air temperature, an induction manifold pressure sensor 34, which records an induction manifold pressure in the collector 6, a crankshaft angle sensor 36 which records a crankshaft angle which is then assigned to a speed and a second temperature sensor 38 which records a coolant temperature.

Furthermore a first exhaust gas probe 42 is provided, which is arranged upstream of the three-way catalyzer 21 and which detects a residual gas content of the exhaust gas and of which the measuring signal is characteristic for the air/fuel ratio in the combustion chamber of the cylinder Z1 and an upstream first exhaust gas probe before the oxidation of the fuel, referred to below as the air/fuel ratio in the cylinders Z1-Z4. Furthermore a second exhaust gas probe 43 is provided, which is arranged downstream of the three-way catalyzer 21 and which detects a residual oxygen content of the exhaust gas and of which the measuring signal is characteristic for the air/fuel ratio in the combustion chamber of the cylinder Z1 and upstream of the second exhaust gas probe 43 before the oxidation of the fuel, referred to below as the air/fuel ratio downstream of the exhaust gas catalyzer.

The first exhaust gas probe 42 is preferably a linear Lambda probe. The second exhaust gas probe 43 is a binary Lambda probe. It can however also be a linear Lambda probe.

Furthermore a fuel pressure sensor 44 is provided, which detects the fuel pressure FUP in a high-pressure fuel accumulator which is coupled hydraulically to the injector.

Depending on the embodiment of the invention, any subset of said sensors can be present or additional sensors can also be present.

The adjusting elements are for example the throttle flap 5, the gas inlet and gas exhaust valves 12, 13, the injector 18 or the spark plug 19.

As well as the cylinder Z1, further cylinders Z2 to Z4 are preferably also provided to which corresponding adjustment elements and where necessary sensors are also assigned.

Figure 2:
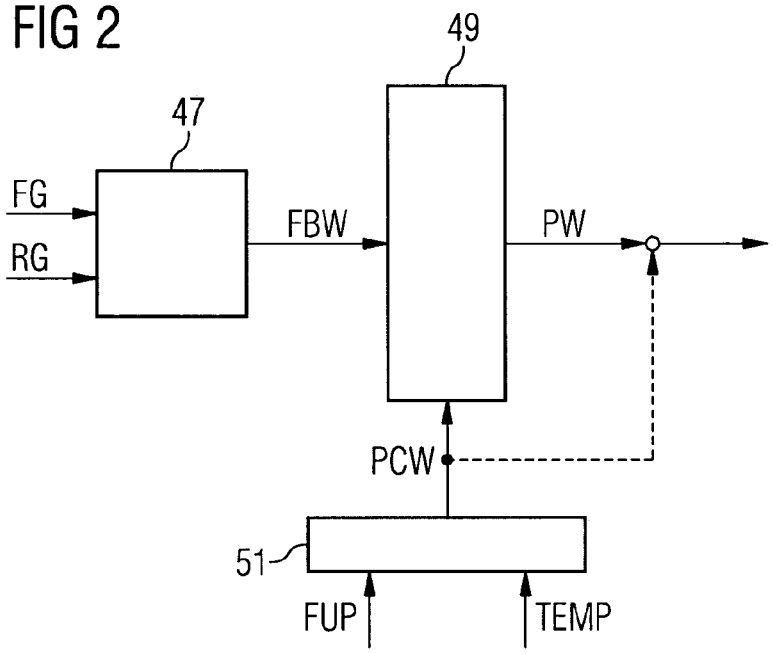
FIG. 2 a regulation device in the control device.

The control device 25 comprises a regulation device (FIG. 2) 45, which comprises a regulator 47, a manipulated variable splitting unit 49 and a pilot control 51. The regulator 47 has as its input variables a command variable FG and a controlled variable RG. Depending on the controlled variable RG and the command variable FG, the regulator is embodied for creating a regulator value FBW of a primary manipulated variable.

The regulator 47 can for example be provided for a cylinder-specific Lambda regulation. In this case the command variable FG is preferably an average air/fuel ratio related to all cylinders Z1-Z4. The controlled variable is in this case preferably the individual air/fuel ratio assigned to the respective cylinders Z1-Z4. The individual air/fuel ratio can be determined by suitable signal evaluation of the measuring signal of the first exhaust gas probe 42. For this purpose the measuring signal of the first exhaust gas probe 42 is sampled at the respective point in time to be assigned to the respective cylinder Z1 to Z4 which has a fixed correlation with the respective crankshaft angle.

The regulator 47 can for example also be embodied as an uneven running regulator. Such an uneven running regulator is especially employed in a lean-burn operation of the internal combustion engine, i.e. in operation with an lean mixture air/fuel ratio. In this case the command variable FG and also the controlled variable RG are values presenting the uneven running of the internal combustion engine. The controlled variable RG is in this case preferably derived from a gradient of the speed of the crankshaft 8 within a cylinder segment assigned to the respective cylinder Z1 to Z4. The gradient of the engine speed is preferably related to the respective speed during the respective cylinder segment. A cylinder segment designates that crankshaft angle range within an operating cycle of an internal combustion engine which is assigned to the respective cylinder Z1 to Z4. Thus the angular range of a cylinder segment for an internal combustion engine with four cylinders Z1 to Z4 for an operating cycle of 720 degrees crankshaft amounts to 180 degrees crankshaft.

The regulator 47 is embodied for determining the regulation difference between the command variable and the controlled variable. The regulator value FBW is then determined as a function of this regulation difference. The regulator 47 can for example contain P, I, $I^2$, D proportions in any given combination or be embodied as any other regulator known to the person skilled in the art for these types of regulation purposes. It can thus be embodied for example as an I, P, PI, PID, $PII^2D$ regulator.

The regulator device 45 can include a number of regulators 47, thus for example the regulator 47 embodied as a cylinder-specific Lambda regulator and the regulator 47 embodied as an uneven running regulator. In addition a number of regulators 47 corresponding to the number of cylinders Z1-Z4 are preferably provided. Accordingly a separate regulation device 45 can also be embodied in the control device 25 for each of the cylinders Z1-Z4.

The primary manipulated variable is a variable which represents an electrical power supplied to the piezo actuator during an activation cycle. An activation cycle can for example begin with the beginning of the activation of the respective piezo actuator of the respective injector 18 for controlling the injector needle from its closed position until a new beginning of the control of the injector needle from its closed position. The manipulated variable can thus for example be the electrical power itself, but it can also be a supplied electrical charge however or also the electrical voltage which drops across the piezo actuator or a corresponding timing curve of the current or of an electrical power.

The pilot control 51 is embodied for determining a pilot control value PCW, which is fed to the manipulated variable splitting unit 49 or is added to a primary value PW of the primary manipulated variable. In this case the pilot control value PCW does not necessarily have to be fed to the manipulated variable splitting unit 49.

The pilot control 51 is preferably embodied for creating the pilot control value PCW as a function of operating variables of the internal combustion engine, which are preferably the fuel pressure FUP and/or an actuator temperature TEMP of the piezo actuator of the injector 18 and/or the duty cycle. The actuator temperature TEMP is preferably determined by means of a suitable physical model, which can also include an engine map or a number of engine maps, depending on the coolant temperature and possibly on the induction air temperature. The suitable physical model can also be embodied so that the actuator temperature TEMP will be determined as a function of capacitance values of the piezo actuator of the injector, especially as a function of detected capacitance fluctuations of the piezo actuator or also as a function of the temperature of the fuel flowing through the injector.

The manipulated variable splitting unit 49 is embodied for determining the primary value PW as a function of the regulator value FBW and possibly of the pilot control value PCW.

The manipulated variable splitting unit 49 is preferably embodied as a program in the control device 25 which is stored in a program memory of the control device 25 and processed during the operation of the internal combustion engine.

Figure 3:
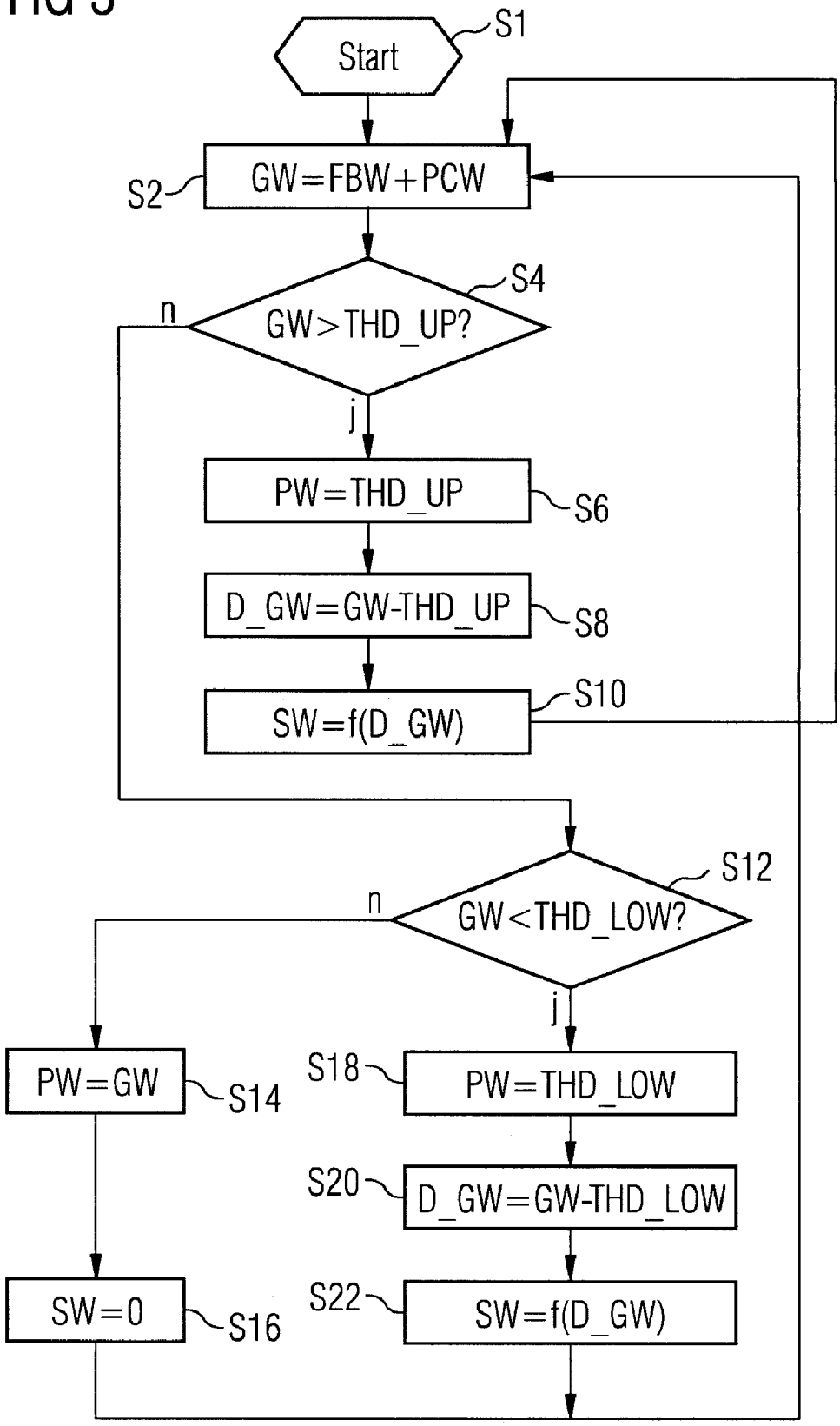
FIG. 3 a first embodiment of a program for the regulation device.
Figure 4:
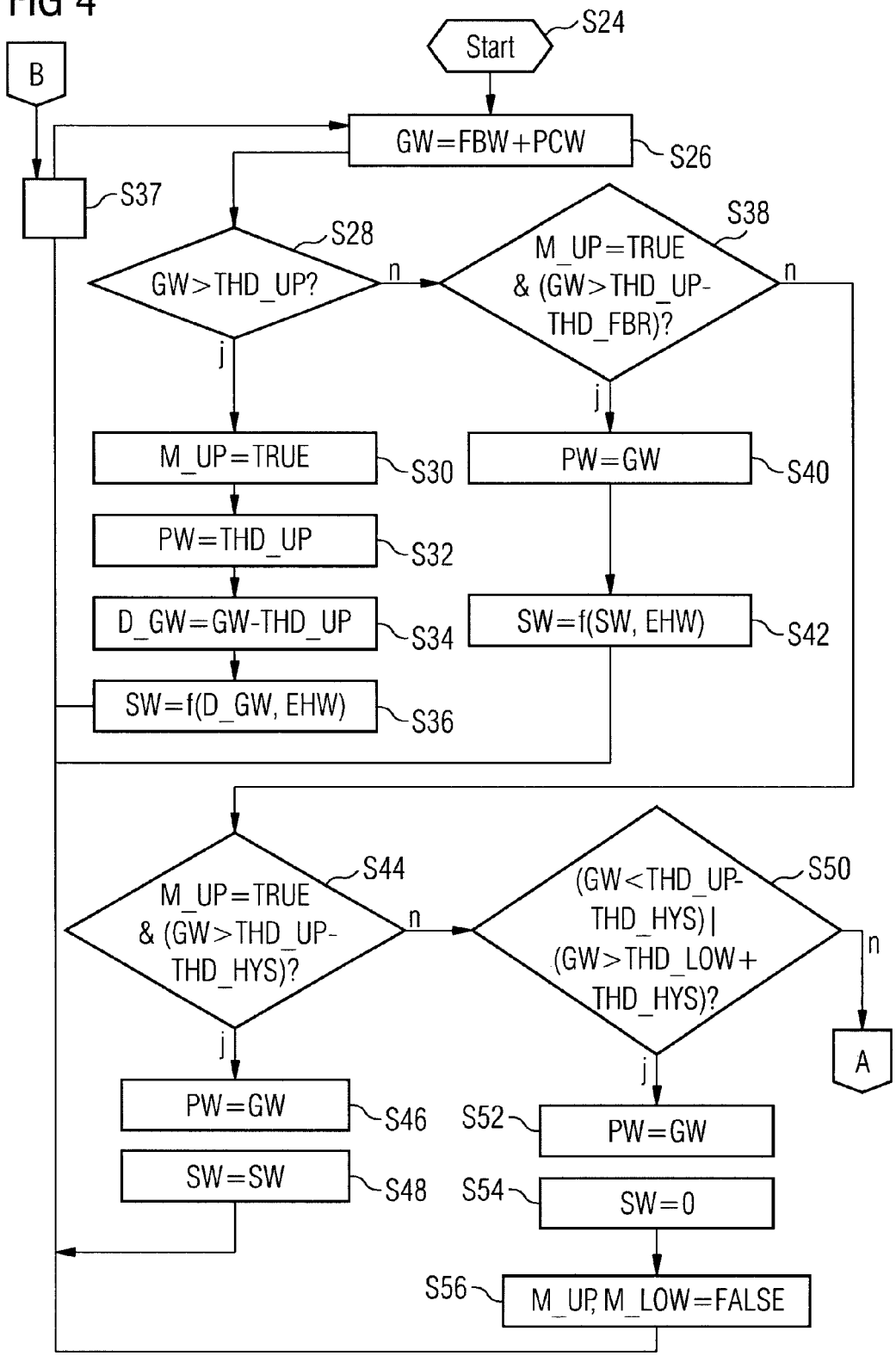
FIGS. 4 and 5 a second embodiment of the program for the regulation device.
Figure 5:
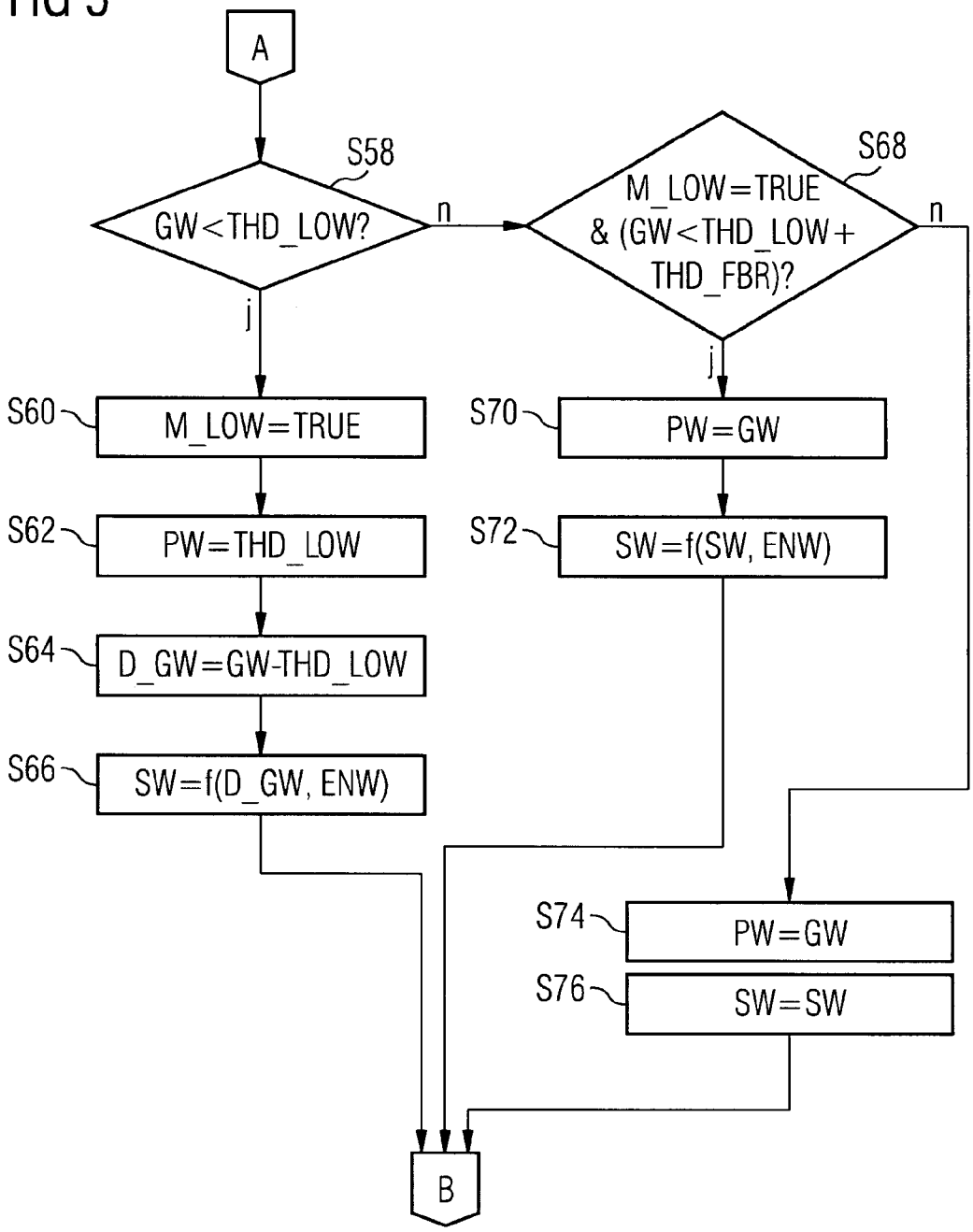

Exemplary embodiments of the program are explained in greater detail below with reference to FIGS. 3, 4 and 5.

A first embodiment of the program for the manipulated variable splitting unit 49 is started in a step S1 (FIG. 3) in which variables are preferably initialized.

In a step S2 a total value GW of the primary manipulated variable is determined by summing the regulator value FBW and of the pilot control value PCW. Alternatively just the regulator value or values FBW can be assigned to the total value GW. Thus the total value GW can be determined if both a cylinder-specific Lambda regulator and an uneven running regulator which each form the regulator 47 by forming the sum of the respective regulator values FBW and possibly the pilot control value PCW are present.

In a step S4 a check is subsequently performed as to whether the total value GW is greater than an upper threshold value THD_UP. If the condition of step S4 is fulfilled, the upper threshold value THD_UP is assigned to the primary value PW of the primary manipulated variable in the step S6. In a step S8 a residual value D_GW is determined by forming a difference between the total value GW and the upper threshold value THD_UP. In a step S10 a secondary value SW of a secondary manipulated variable is determined as a function of the residual value D_GW. This is preferably done by means of suitable characteristic curve or a suitable engine map by engine map checkpoint interpolation. The second manipulated variable is preferably a variable which represents the injection time of the injector 18. It can thus for example be a correction value for the injection time, but it can however also be a correction value for a fuel mass to be supplied, with a corresponding corrected fuel mass to be supplied being included for determining the injection time.

The primary value PW and the secondary value SW are subsequently set by appropriate activation of the injector 18, before the processing is continued again, if necessary after a predetermined waiting time or a predetermined crankshaft angular range, in step S2.

If the condition of step S4 is not fulfilled on the other hand, then in a step S12 a check is performed as to whether the total value GW is less than a predetermined lower threshold value THD_LOW. If it is not, then in a step S14 the primary value PW is assigned the total value GW and in a step S16 the secondary value SW is assigned a neutral value. Subsequently the primary value PW is then set by appropriate activation of the injector 18 and the processing of the program is likewise continued again in a step S2, if necessary after a predetermined wait time or a predetermined crankshaft angular range has passed.

If the condition of step S12 is fulfilled on the other hand, in a step S18 the primary value PW is assigned the lower threshold value THD_LOW. In a step S20 the residual value D_GW is assigned the difference between the total value GW and the lower threshold value THD_LOW. In a step S22 the secondary value is determined as a function of the residual value D_GW in a similar process to step S10. Subsequently the primary value PW and also the secondary value SW are then set by appropriate activation of the injector 18.

The upper and lower threshold values THD_UP, THD_LOW are preferably predetermined so that a maximum or minimum electrical power to be supplied to the piezo actuator is not exceeded or undershot.

A second embodiment of the program is explained in greater detail below with reference to FIGS. 4 and 5. The program is started in a step S24 in which variables are initialized where necessary. In a step S26 the total value, as in step S2, is assigned the regulator value FBW and the pilot control value PC and where necessary the pilot control value PCW. In a step S28 a check is subsequently performed as to whether the total value GW is greater than the upper threshold value THD_UP.

If it is, in a step S30 a first marker M_UP is set to a value of TRUE. Subsequently in a step S32, the primary value PW is assigned the upper threshold value THD_UP. Furthermore in a step S34 the residual value D_GW is determined by forming the difference between the total value GW and the upper threshold value THD_UP.

In a step S36 the secondary value SW is determined as a function of the residual value D_GW and an increment value EHW. The increment value can for example be fixed beforehand or also be embodied for consecutive passes of the step S36, while the first marker M_UP continues to be set to TRUE, so that it increases in each case. The assignment specification of step S36 is embodied so that the secondary value is assigned a higher value by the increment value EHW with the same residual value D_GW than is the case in step S10.

Subsequently processing is continued in a step S37 in which the primary value PW and the secondary value SW are set by appropriate activation of the respective injector 18. Thereafter the program preferably waits until a predeterminable waiting time or a predeterminable crankshaft angle has passed in the step S37, before processing is continued again in the step S26.

If the condition of step S28 is not fulfilled, a check is performed in a step S38 as to whether the first marker M_UP is set to the value TRUE and the total value GW is greater than the upper threshold value THD_UP reduced by a regulation reserve threshold value THD_FBR.

If the condition of step S38 is fulfilled, in a step S40 the primary value PW is assigned the total value assigned and in a step S42 the secondary value SW is assigned a value which is calculated as a function of the incrementation value EHW and the secondary value determined during the last determination of the secondary value. The calculation specification is preferably embodied in step S42 so that the incrementation value EHW causes the secondary value to be increased by comparison with the last time that it was calculated. Subsequently the processing is continued in step S37.

If on the other hand the condition of step S38 is not fulfilled, a check is performed in a step S44 as to whether the first marker M_UP has the value of true and whether the total value is greater than the upper threshold value THD_UP reduced by a hysteresis threshold value THD_HYS. If the condition of step S44 is fulfilled, in a step S46 the primary value is assigned the total value and in a step S48 the secondary value is assigned the last determined secondary value. Subsequently the processing is continued in step S37.

If on the other hand the condition of step S44 is not fulfilled, a check is performed in a step S50 as to whether the total value GW is less than the upper threshold value THD_UP reduced by the hysteresis threshold value THD_HYS or whether the total value GW is greater than the lower threshold value THD_LOW increased by the hysteresis threshold value THD_HYS. If the condition of step S50 is fulfilled, in a step S52 the primary value PW is assigned the total value GW and in a step S54 the secondary value is set to a neutral value. Further in a step S56 the first marker M_UP and a second marker M_LOW are assigned a value of FALSE. Subsequently the processing is continued in step S37.

If on the other hand the condition of step S50 is not fulfilled, a check is performed in a step S58 as to whether the total value GW is less than the lower threshold value THD_LOW. If it is, in a step S60 the second marker M_LOW is set to the value TRUE. Subsequently in a step S62, the primary value PW is assigned the lower threshold value THD_LOW. In a step S64 the residual value D_GW is assigned the difference between the total value GW and the lower threshold value THD_LOW. Subsequently in a step S66, the secondary value SW is determined as a function of the residual value D_GW and a reduction value EN_W is determined in a similar manner to the method used in step S36, with the reduction value EN_W leading to a reduction of the secondary value SW. Subsequently the processing is continued in step S37.

If on the other hand the condition of step S58 is not fulfilled, a check is performed in a step S68 as to whether the second marker M_LOW has the value TRUE and whether the total value GW is less than the lower threshold value THD_LOW increased by the regulation reserve threshold value THD_FBR. If this is the case, in a step S70 the primary value PW is assigned the total value assigned and the secondary value SW is determined in a step S72 as a function of the secondary value SW determined the last time that the secondary value SW was calculated and the reduction value ENW. This is correspondingly done in a similar way to the method used in step S42. Subsequently the processing is continued in step S37.

If on the other hand the condition of step S68 is not fulfilled, in a step S74 the primary value is assigned the total value GW and in a step S76 the secondary value SW is left unchanged. Subsequently the processing is continued in step S37.

Suitable predetermination of the regulation reserve threshold value THD_FBR gives a simple guarantee that a corresponding desired regulation reserve is set in respect of the primary manipulated variable. A higher quality of regulation can then be guaranteed, since the controller 47 is embodied for determining the regulator value FBW of the primary manipulated variable and so possible inaccuracies in respect of driving behavior as regards the secondary variable can be taken into account in any event without influencing the quality of regulation. The regulation reserve threshold value THD_FBR amounts for example to 10% of the upper threshold value THD_UP.

The hysteresis threshold value THD_HYS is suitably predetermined so as to effect a desired hysteresis behavior, it can for example amount to around 20 percent of the difference between the upper and the lower threshold value THD_UP, THD_LOW.

The increment value EHW can also be embodied so that, for consecutive passes of step S36, it merely effects a constant, consistent increase in the secondary value by comparison with step S10. Accordingly provision can also be made for the secondary value SW to be determined independently of the increment value EHW in the step S42. The same then applies for steps S66 and S72 with respect to the reduction value ENW.

The invention claimed is:

1. A regulator device for compensating for dispersions of a plurality of piezo actuated injectors in each case are assigned to cylinders of an internal combustion engine, comprising:

a control device configured to provide a cylinder-specific controlled variable and a command variable, of which a primary manipulated variable is a variable that represents an electrical power supplied during an activation cycle to the piezo actuator; and a manipulated variable splitting unit where the input variable is a regulator value of the primary manipulated variable determined by the regulator is embodied for determining a total value of the primary manipulated variable as a function of the regulator value, for splitting the total value into a primary value of the primary manipulated variable and a secondary value of a secondary manipulated variable as a function of a lower and/or upper threshold value of the total value where the manipulated variable splitting unit increases the secondary value beyond the amount needed for implementing the difference between the total value and the primary value if the regulator value exceeds the upper threshold value, and retaining the increase until the regulator value falls below a hysteresis threshold value in relation to the upper threshold value.

2. The regulator device as claimed in claim 1, wherein the manipulated variable splitting unit increasingly raises the secondary value beyond the amount needed to implement the difference between the regulator value and the primary value until the regulator value falls below a regulation reserve threshold value in relation to the upper threshold value.

3. A regulator device for compensating for dispersions of a plurality of piezo actuated injectors in each case are assigued to cylinders of an internal combustion engine that supplies a cylinder-specific controlled variable and a command variable to a regulator, of which the primary manipulated variable is a variable which represents an electrical power supplied during an activation cycle to the piezo actuator, comprising:

a manipulated variable splitting unit wherein the input variable is a regulator value of the primary manipulated variable determined by the regulator and which is embodied for determining a total value of the primary manipulated variable as a function of the regulator value, for splitting the total value into a primary value of the primary manipulated variable and a secondary value of a secondary manipulated variable as a function of a lower and/or upper threshold value of the total value, with the manipulated variable splitting unit being embodied to increase the secondary value beyond the amount needed for implementing the difference between the total value and the primary value, if the regulator value falls below the lower threshold value, and retaining the decrease until the regulator value exceeds a hysteresis threshold value in relation to the lower threshold value.

4. The regulator device as claimed in claim 3, wherein the manipulated variable splitting unit increasingly reduces the secondary value beyond the amount needed for the implementation of the difference of the regulator value and the primary value until the regulator value exceeds a regulator reserve threshold value in relation to the lower threshold value.

5. The regulator device as claimed in claim 4, wherein the manipulated variable splitting unit increases the secondary value beyond the amount needed to implement the difference between the total value and of the primary value, if the regulator value exceeds the upper threshold value, and to retain the increase until the regulator value falls below a hysteresis threshold value in relation to the upper threshold value.

6. The regulator device as claimed in claim 5, wherein the manipulated variable splitting unit raises the secondary value beyond the amount needed to implement the difference between the regulator value and the primary value until the regulator value falls below a regulation reserve threshold value in relation to the upper threshold value.

7. The regulator device as claimed in claim 6, wherein the manipulated variable splitting unit limits the range of values of the primary value in respect of its lower value range limit to the lower threshold value, and/or in relation to its upper value range limit, to the upper threshold value.

8. The regulator device as claimed in claim 7, wherein the regulator is a cylinder-specific Lambda regulator.

9. The regulator device as claimed in claim 8, wherein the regulator is an uneven running regulator.

10. The regulator device as claimed in claim 9, wherein the regulator determines the total value as a function of a pilot control value of the primary manipulated variable, which is determined as a function of at least one operating variable of the internal combustion engine.

11. The regulator device as claimed in claim 10, wherein the secondary manipulated variable represents the injection time of the injector.

* * * * *